United States Patent [19]

Lefevre et al.

[11] Patent Number: 4,658,782

[45] Date of Patent: Apr. 21, 1987

[54] PROCESS AND DEVICE FOR CONTROLLING THE AIR FLOW OF AN IDLING HEAT ENGINE

[75] Inventors: Rémi Lefevre, Colombes; Gérard Saint Leger, Villejuif, both of France

[73] Assignee: Regie Nationale Des Usines Renault, Boulogne-Billancourt, France

[21] Appl. No.: 757,298

[22] Filed: Jul. 22, 1985

[30] Foreign Application Priority Data

Jul. 23, 1984 [FR] France ..... 84 11667

[51] Int. Cl.[4] ..... F02M 3/07

[52] U.S. Cl. ..... 723/339; 123/352

[58] Field of Search ..... 123/339, 352–355, 123/418, 585; 180/176, 177, 178, 179

[56] References Cited

U.S. PATENT DOCUMENTS

| | | | |
|---|---|---|---|
| 4,280,189 | 7/1981 | Takato et al. . | |
| 4,307,690 | 12/1981 | Rau et al. | 123/353 |
| 4,345,559 | 8/1982 | Kuttner et al. | 123/436 X |
| 4,386,591 | 6/1983 | Nagase et al. . | |
| 4,401,075 | 8/1983 | O'Keefe, Jr. et al. | 180/178 X |
| 4,406,262 | 9/1983 | Ikeura | 123/339 |
| 4,498,438 | 2/1985 | Sato | 123/418 |
| 4,538,571 | 9/1985 | Buck et al. | 123/352 X |
| 4,552,109 | 11/1985 | Boccadoro et al. | 123/339 |

FOREIGN PATENT DOCUMENTS

| | | |
|---|---|---|
| 2462562 | 2/1981 | France . |
| 2538034 | 6/1984 | France . |
| 1347304 | 2/1974 | United Kingdom . |
| 2085619 | 4/1982 | United Kingdom . |

*Primary Examiner*—Tony M. Argenbright

*Attorney, Agent, or Firm*—Oblon, Fisher, Spivak, McClelland & Maier

[57] ABSTRACT

A process and apparatus for controlling the air flow at the intake of a heat engine fed by fuel injection. The air flow is controlled as a function of the rotational speed of the engine, particularly in the vicinity of the rated idling speed. The control point is determined as a result of a filtering made on a value linked to the instantaneous value of the rotational speed of the engine followed by a weighted average between the filtered value and a magnitude linked to the rated idling speed.

1 Claim, 4 Drawing Figures

PROCESS AND DEVICE FOR CONTROLLING THE AIR FLOW OF AN IDLING HEAT ENGINE

BACKGROUND OF THE INVENTION

1. Field of the Invention

This invention relates generally to a process and apparatus for controlling the air flow at the intake of a heat engine and more particularly to a process and apparatus for controlling the air flow of a heat engine of a motor vehicle fed by fuel injection in which the air flow is controlled as a function of rotational speed of the engine, especially near the rated rotational idling speed.

2. Discussion of Background

It is known that the idling speed of a heat engine is traditionally controlled mainly by the air flow in the intake pipe. By correctly controlling the richness and advance, a stable rotational speed is successfully obtained in the absence of external disturbances. On the other hand, when a heat engine requires additional power to operate a peripheral element, such as, for example, power steering or other element, the idling balance is disturbed and the static timing of the speed cannot compensate for the imposed load variation.

In order to reestablish the idling speed of such a heat engine, prior art devices have used an actuator to modify the air flow in the intake pipe. Controlling this actuator makes it possible to maintain an idling speed independently of conditions external to the heat engine and to obtain more stable idling by compensating for inevitable small variations in the engine. The control of the air flow can be realized in different ways. For example, it is possible to control an independent valve used as a bypass on the main intake flow of the engine. It is also possible to act directly on the butterfly valve connected to the accelerator control of the vehicle.

In prior art devices of this type, the control of the engine rotational speed by the actuator is therefore similar to a servo system of the air flow at the intake. However, problems are encountered when trying to put such devices into practice, particularly during transient phenomena. Actually, it is difficult for standard type controls to differentiate between an idling stabilizing action and a poorly defined transient phenomena that can exist in a heat engine. This is particularly the case during a rapid deceleration of the heat engine which can cause the speed of the engine to drop greatly below normal speeds or even cause a complete stall with the engine stopping.

SUMMARY OF THE INVENTION

Accordingly, one object of this invention is to provide a novel control for the air flow to a heat engine.

Another object of this invention is to provide a novel method and apparatus for controlling the air flow at the intake of a heat engine used in a motor vehicle at idling speeds.

A further object of this invention is to provide a novel method and apparatus for controlling the air flow of a heat engine during transient phenomena by providing an anticipation in the control of the actuator.

A still further object of this invention is to provide a novel method and apparatus for controlling the air flow of a heat engine as a function of the rated idling speed of the engine using as a control point a filtered value of the rotational speed.

Another object of this invention is to provide a novel method and apparatus for controlling the air flow of a heat engine varying a proportional-integral type control.

Briefly, these and other objects of the invention are achieved by providing a control point which is the result of filtering performed on a value related to the instantaneous value of the rotational speed of the heat engine followed by a weighted average between the filtered value thus obtained and a magnitude linked to the rated idling speed. This filtering is preferably accomplished by a first-order system similar to a low-pass filter. The gain and time constant of the first-order system used for the filtering is preferably selected so that the overall transfer function brings a maximum phase advance in the vicinity of the maximum frequency of the oscillations of the engine at idling speed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Control of the air flow at the intake of a heat engine requires a suitable servo action on the air admitted into the heat engine. In the case of control by means of a valve, it is a matter, therefore, of opening this valve when the speed or rotational speed of the heat engine is too low and, on the other hand, in closing it when the speed or rotational speed of the heat engine is too high. To perform a suitable control in the case of a transient phenomenon, it does not suffice to open the valve below the idling speed, i.e., below the rated idling speed of the heat engine, because the action on the air at intake would then occur too slowly to compensate for a sudden drop of the speed of the heat engine, possibly causing a sudden stopping of the engine.

Figure 1:
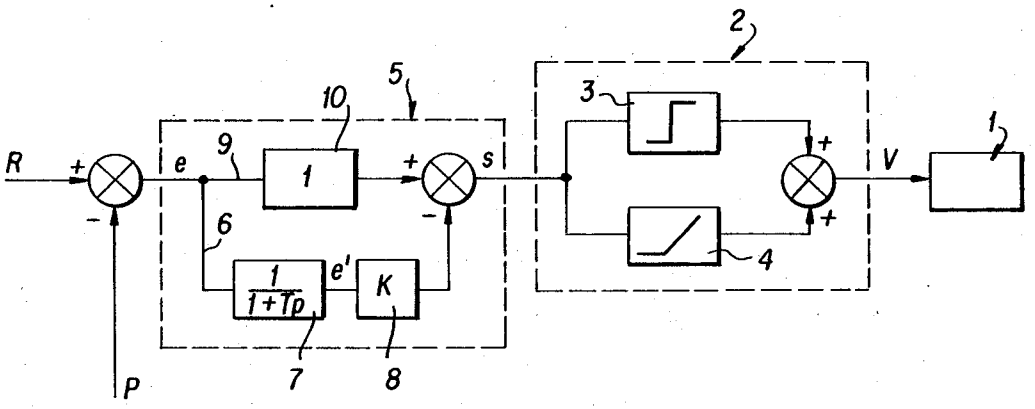
FIG. 1 is a schematic diagram of the main elements of the servo system comprising the controller of the present invention.

Referring now to the drawings, wherein like reference numerals disignate identical or corresponding parts throughout the several views, and more particularly to FIG. 1 thereof, which shows very diagrammatically one example of the present invention as including a control valve 1 able to act on the air taken into a heat engine, not shown. The control signal of the valve, V, is produced by a servo system 2 in its entirety, a proportional correction having been made by element 3 and an integral correction having been made by element 4 on starting input signal S.

In a standard system, input s of the servo system 2 would consist of the difference between magnitude P linked to the instantaneous value of the rotational speed of the heat engine and a magnitude R linked to the idling speed or rated rotational speed of the idling heat engine, this value being preset for a given heat engine.

According to the present invention, this difference $e=P-R$, is first subjected to a transformation in a controller 5. In other words, the control of valve 1 is not achieved by directly taking as the control point the desired constant idling speed linked to magnitude R but, on the contary, by starting from a variable fictitious control point which is speed dependent on the instantaneous speed.

The controller according to the present invention comprises a first branch 6 provided with an element 7 acting like a first-order system and a proportional element 8.

By way of example, there will now be described the action of the various elements of the system where the measured magnitudes linked to the values of the rotational speed of the heat engine are periods, i.e., the inverse of the rotational speeds.

Under these conditions, the instantaneous speed of the engine is represented by the value of the instantaneous period P. The idling speed, which is constant, is represented by the period of idling R.

According to the invention, first a filtering is made of instantaneous period P as to obtain filter value P'. This filtering is performed by the first-order system 7 whose input P is linked to output P' by the linear differential equation:

$$P=P'+T(dP'/dt)$$

In the case of the controller of FIG. 1, the input of filter 7 is the difference P−R. Because idling period R is constant, the output of filter 7 therefore is P'−R.

According to the invention, the control point selected for the servo system of control valve 1 is a control point period C which consists of the weighted average between the filtered value of instantaneous period P' and idling period R. The control point therefore is selected by definition in the following way:

$$C=KP'+(1-K)R$$

Under these conditions, input signal s of servo system 2 which is the difference between instantaneous period P and control point period C is obtained by the following equation:

$$P-C=P-R-K(P'-R)$$

This equation can be written: $s=e-Ke'$ by adopting the symbols appearing in FIG. 1 where e represents the input signal of controller 5, e' represents the output of filter 7 and s represents the output of controller 5.

Under these conditions and according to the present invention, signal e at the input of controller 5 is subjected in a first branch to a first filtering 7 to provide filtered signal e' which is then received by proportional element 8 of coefficient K. The same input signal e is subjected in a second branch 9 of the controller 5 to the action of proportional element 10 of coefficient 1. The output of first branch 6 is subtracted from the output of second branch 9 to provide output signal s.

It is seen that the transfer function of controller 5 has the form:

$$F_1=1-(K/1+Tp)$$

The transfer function of servo system 2 placed downstream and in series with controller 5 has the form:

$$F_2=K_p+K_i/p$$

where $K_p$ is the coefficient of proportional element 3, while $K_i$ is the coefficient of integral element 4. The overall transfer function of the system can then be written:

$$\frac{1+T_p-K}{1+T_p}\left(K_p+\frac{K_i}{p}\right)$$

Figure 2:
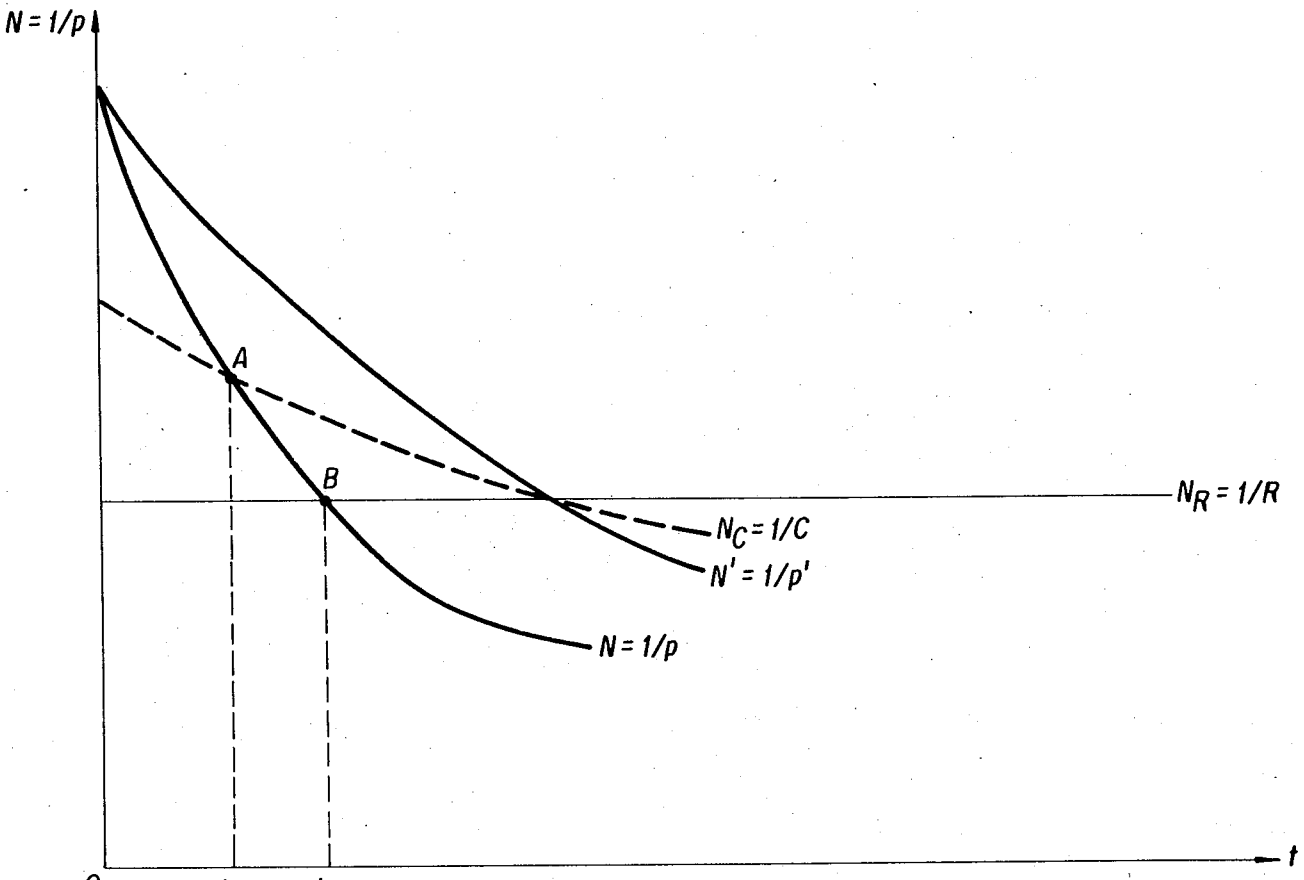
FIG. 2 is a graph comparing curves of the rotational speed versus time for the present invention and prior art systems and FIGS. 3 and 4 respectively represent the modulus and the phase of the transfer function of the controller used in this invention.

Reference is now made to FIG. 2 in which ordinates represent the values of the instantaneous rotational speeds N of a heat engine, i.e., the inverse values of periods P and the abscissas represent time t. In the case of a transient phenomenon brought about by a rapid deceleration of the speed of the heat engine which can be seen on the curve referenced N, it is seen that in a standard type servo system, the air intake control valve would be open at time $t_2$ when instantaneous speed N becomes equal to constant, predetermined idling speed $N_R$ (intersection B of curves N and $N_R$).

According to the present invention, instantaneous speed N is filtered so as to obtain a variable filtered speed N' whose evolution is represented on the curve of FIG. 2 referenced N'. The filtered value is again transformed by taking the weighted average which was explained above so as to obtain a control point for the engine speed whose evolution is represented by the curve referenced $N_c$. This control point is used as the input of the servo system. Under these conditions, the action of the control valve occurs as time $t_1$, i.e., at the moment when the difference between control point $N_c$ and instantaneous value N is zero, at point A.

The invention therefore makes it possible to anticipate the action on the valve control, such as, in case of a sudden drop of the instantaneous speed of the heat engine, keeping the engine from stopping suddenly.

In a standard type servo system, the input signal consists of the difference between the instantaneous speed (N or P) and the idling speed ($N_R$ or R) while, according to the invention, the control point consists of output s of controller 5, i.e., the difference between control point speed $N_c$ and the idling speed ($N_R$ or R).

Figure 3:
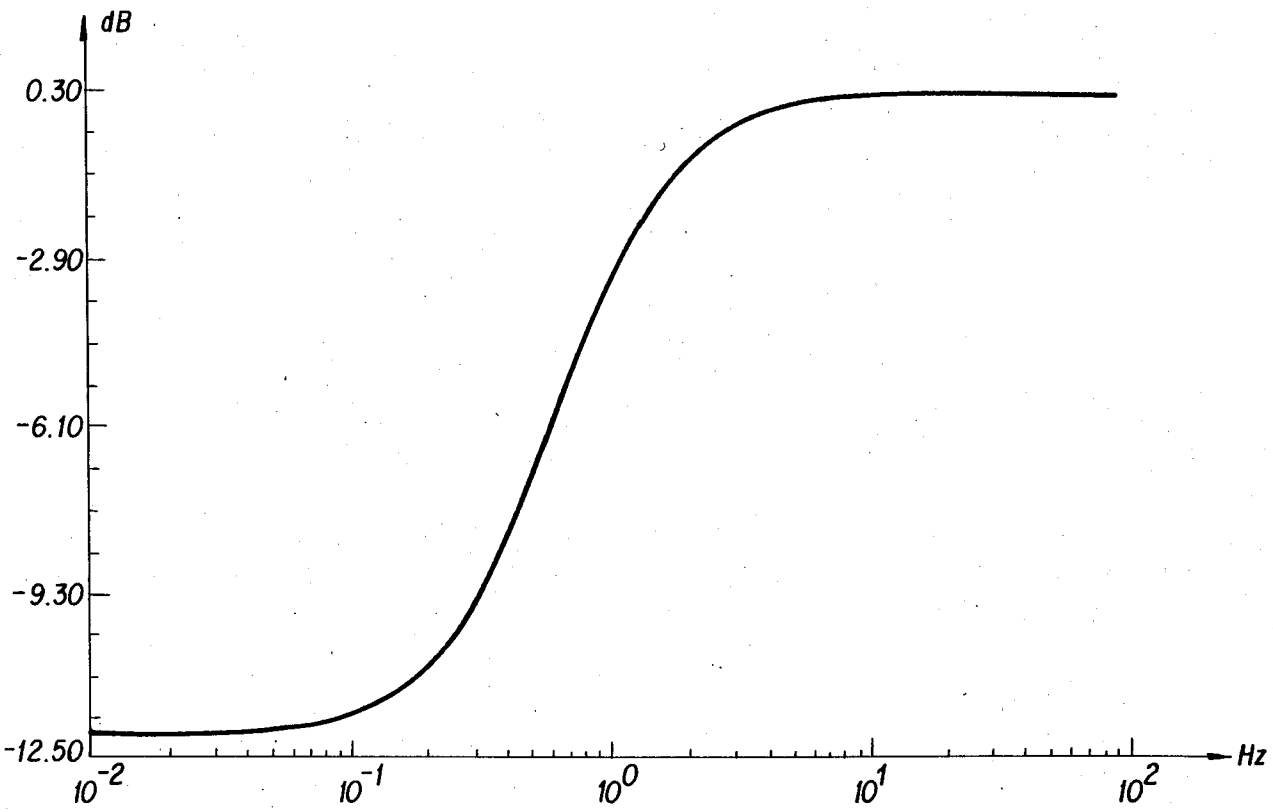

The frequency responses in amplitude and phase of controller 5 of FIG. 1 are illustrated by way of example. FIG. 3 represents variations of the modulus or ratio of amplitudes of the output signal to the input signal expressed in decibels as a function of the pulse expressed in hertz and represented on a logarithmic scale. If it is desired to attenuate the decrease in gain in the vicinity of low frequencies, it is possible to act on the characteristics of servo system 2, for example, by an increase of integral term $K_i$.

Figure 4:
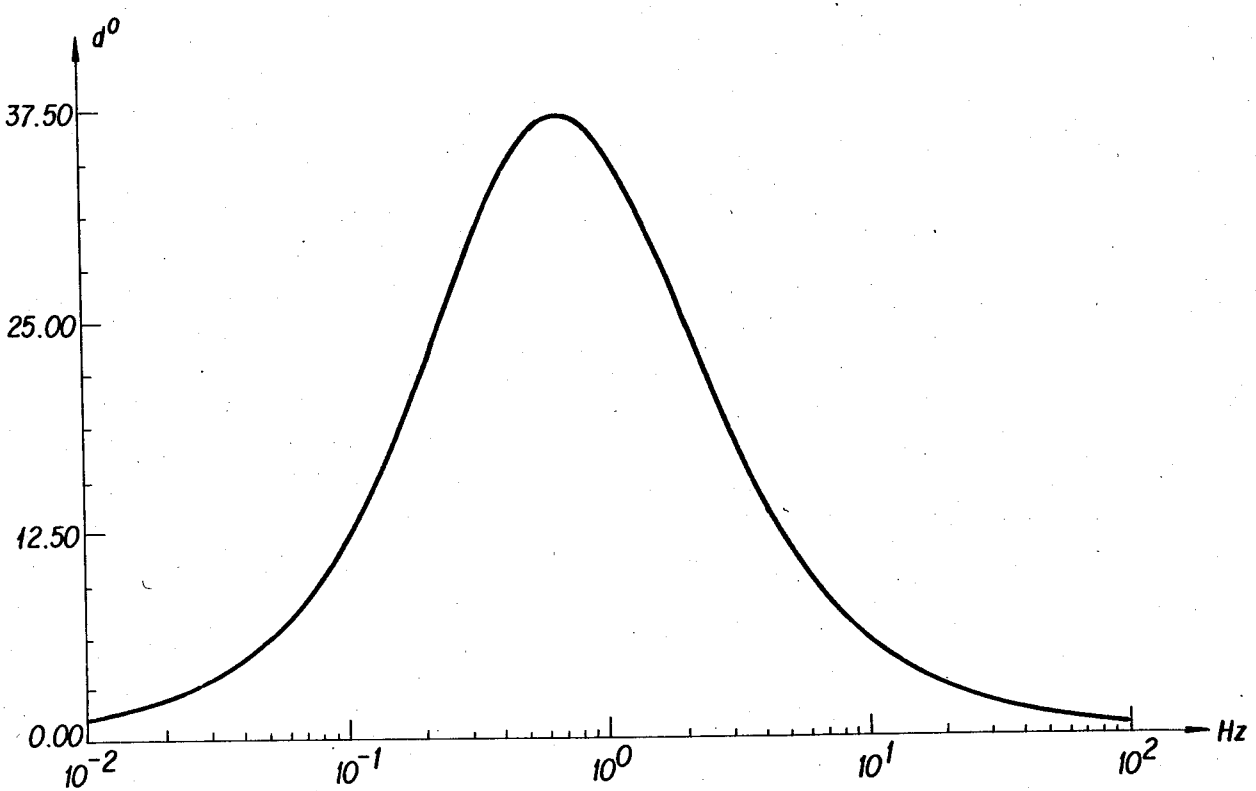

FIG. 4 represents the variations of the phase expressed in degrees as a function of the pulse expressed in hertz on a logarithmic scale. As can be seen, the controller of the invention brings a phase advance with a maximum which is located in the vicinity of 0.7 to 0.8 Hz. Under these conditions, the maximum phase advance is in the vicinity of the maximum frequency of the oscillations of the engine at its idling speed which is generally on the order of 0.5 to 1 Hz.

Finally, the addition of the controller of the present invention makes it possible to act on the servo system and, for example, to open the air intake control valve in the heat engine at transient speed, for example, in the case of deceleration on no-load before the speed of the heat engine is less than the idling speed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for controlling the air flow at the intake of a heat engine fed by fuel injection, said apparatus comprising:

(a) first means for varying the air flow at the intake of a heat engine;

(b) second means for calculating:

$$e=P-R$$

wherein the magnitude P is the instantaneous period of the heat engine and the magnitude R is the period of the preset rated rotational speed of the heat engine at idle;

(c) third means for subjecting the value e to a transformation, said third means comprising a controller comprising:

(i) a first branch comprising a first-order system and a proportional element in series with said first-order system, said first-order system filtering the value e to obtain a value $e'=P'-R$ wherein:

$$P'=P-T(dP'/dt)$$

and said proportional element multiplying the value e' by a constant K;

(ii) a second branch comprising a proportional element that multiplies the value e by the coefficient 1; and (iii) fourth means for subtracting the output of said first branch from the output of said second branch to obtain an output signal s;

(c) a servo system the input of which is the output signal s of said controller, said servo system comprising a proportional correction element, an integral correction element in parallel with said proportional correction element, and fifth means for adding the output of said proportional correction element to the output of said integral correction element to obtain a control signal V; and (d) sixth means for inputting said control signal V to said first means.

* * * * *